US009643397B2

(12) United States Patent
Stowe et al.

(10) Patent No.: US 9,643,397 B2
(45) Date of Patent: May 9, 2017

(54) VARIABLE DATA LITHOGRAPHY SYSTEM FOR APPLYING MULTI-COMPONENT IMAGES AND SYSTEMS THEREFOR

(71) Applicant: Palo Alto Research Center Incorporated, Palo Alto, CA (US)

(72) Inventors: Timothy D. Stowe, Alameda, CA (US); Eric Peeters, Mt. View, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 46 days.

(21) Appl. No.: 14/580,108

(22) Filed: Dec. 22, 2014

(65) Prior Publication Data

US 2015/0101502 A1 Apr. 16, 2015

Related U.S. Application Data

(60) Division of application No. 13/204,567, filed on Aug. 5, 2011, which is a continuation-in-part of application No. 13/095,714, filed on Apr. 27, 2011.

(Continued)

(51) Int. Cl.
*B41F 7/24* (2006.01)
*B41F 7/02* (2006.01)

(Continued)

(52) U.S. Cl.
CPC ..... *B41F 7/24* (2013.01); *B41F 7/00* (2013.01); *B41F 7/025* (2013.01); *B41F 7/26* (2013.01);

(Continued)

(58) Field of Classification Search
CPC .... B41F 7/24; B41F 7/025; B41F 7/00; B41F 31/302; B41F 31/18; B41F 3/42; B41F 3/44; B41F 5/16; B41F 9/02
See application file for complete search history.

(56) References Cited

U.S. PATENT DOCUMENTS 3,656,200 A 4/1972 Riley, Jr.
3,677,329 A 7/1972 Kirkpatrick (Continued)

FOREIGN PATENT DOCUMENTS

CH 277540 A 8/1951
DE 26 29 708 A1 7/1977

(Continued)

OTHER PUBLICATIONS

Shen et al., "A new understanding on the mechanism of fountain solution in the prevention of ink transfer to the non-image area in conventional offset lithography", J. Adhesion Sci. Technol. vol. 18, No. 15-16, pp. 1861-1887 (2004).

(Continued)

*Primary Examiner* — Matthew G Marini
*Assistant Examiner* — Quang X Nguyen
(74) *Attorney, Agent, or Firm* — Prass LLP

(57) ABSTRACT

A reimageable layer of an imaging member is provided with a dampening fluid layer. The reimageable layer has specific properties such as composition, surface profile, and so on so as to be well suited for receipt and carrying the dampening fluid layer. An optical patterning subsystem such as a scanned modulated laser patterns the dampening fluid layer. Ink having a first set of properties such as color, composition, etc., is applied at an inking subsystem such that it selectively resides in voids formed by the patterning subsystem in the dampening fluid layer to thereby form an inked latent image. The inked latent image is then transferred to a substrate, and the reimageable surface cleaned. The process is repeated for a second ink having properties different than the first. Each ink image may successively be applied to the substrate, or a composite image may be formed then applied to the substrate.

8 Claims, 8 Drawing Sheets

Related U.S. Application Data

(60) Provisional application No. 61/408,552, filed on Oct. 29, 2010, provisional application No. 61/408,554, filed on Oct. 29, 2010, provisional application No. 61/408,556, filed on Oct. 29, 2010.

(51) Int. Cl.
*B41F 7/00* (2006.01)
*B41F 7/26* (2006.01)
*B41F 31/30* (2006.01)
*B41F 35/02* (2006.01)

(52) U.S. Cl.
CPC ..... *B41F 31/302* (2013.01); *B41F 35/02* (2013.01); *B41P 2227/70* (2013.01)

(56) References Cited

U.S. PATENT DOCUMENTS

| | | | | |
|---|---|---|---|---|
| 3,741,118 | A | 6/1973 | Carley | |
| 3,800,699 | A | 4/1974 | Carley | |
| 3,850,649 | A | 11/1974 | Buerkley et al. | |
| 3,871,081 | A | 3/1975 | Inoue et al. | |
| 3,877,372 | A | 4/1975 | Leeds | |
| 4,395,113 | A | 7/1983 | Buchan et al. | |
| 4,395,946 | A * | 8/1983 | Price | B41F 13/00 101/152 |
| 4,439,035 | A | 3/1984 | Landa | |
| 4,627,349 | A | 12/1986 | Claussen | |
| 4,729,310 | A | 3/1988 | Love, III | |
| 4,811,661 | A | 3/1989 | Maruta | |
| 4,887,528 | A | 12/1989 | Ruge et al. | |
| 4,890,135 | A | 12/1989 | Gardiner et al. | |
| 5,067,404 | A | 11/1991 | Frunder et al. | |
| 5,213,042 | A * | 5/1993 | Larios | 101/450.1 |
| 5,218,905 | A | 6/1993 | Bolte et al. | |
| 5,365,849 | A | 11/1994 | Spiegel | |
| 5,701,815 | A | 12/1997 | Bocko et al. | |
| 5,855,173 | A | 1/1999 | Chatterjee et al. | |
| 5,909,708 | A | 6/1999 | Bolza-Schünemann | |
| 5,954,911 | A | 9/1999 | Bergman et al. | |
| 6,029,577 | A | 2/2000 | Fukuoka et al. | |
| 6,125,756 | A | 10/2000 | Nüssel et al. | |
| 6,146,798 | A | 11/2000 | Bringans et al. | |
| 6,152,032 | A | 11/2000 | Belanger et al. | |
| 6,298,780 | B1 | 10/2001 | Ben-Horin et al. | |
| 6,318,264 | B1 | 11/2001 | D'Heureuse et al. | |
| 6,341,559 | B1 | 1/2002 | Riepenhoff et al. | |
| 6,458,507 | B1 | 10/2002 | Burberry et al. | |
| 6,539,859 | B2 | 4/2003 | Williams | |
| 6,561,090 | B1 | 5/2003 | Spooner | |
| 6,725,777 | B2 | 4/2004 | Katano | |
| 6,796,227 | B1 | 9/2004 | Miller | |
| 6,841,336 | B2 | 1/2005 | Kondo | |
| 6,901,853 | B2 | 6/2005 | Baldy et al. | |
| 7,020,355 | B2 | 3/2006 | Lahann et al. | |
| 7,061,513 | B2 | 6/2006 | Katano et al. | |
| 7,100,503 | B2 | 9/2006 | Wiedemer et al. | |
| 7,152,528 | B2 * | 12/2006 | Hesterman | B41F 7/08 101/232 |
| 7,191,705 | B2 | 3/2007 | Berg et al. | |
| 7,421,948 | B2 | 9/2008 | Schneider et al. | |
| 7,717,039 | B2 | 5/2010 | Becker et al. | |
| 2003/0167950 | A1 | 9/2003 | Mori | |
| 2004/0011234 | A1 | 1/2004 | Figov et al. | |
| 2005/0028698 | A1 | 2/2005 | Mori et al. | |
| 2005/0155503 | A1 * | 7/2005 | Onuma | B41F 7/06 101/177 |
| 2005/0175833 | A1 | 8/2005 | Yoneda | |
| 2005/0258136 | A1 * | 11/2005 | Kawanishi | B21B 1/227 216/54 |
| 2006/0152566 | A1 | 7/2006 | Taniuchi et al. | |
| 2006/0243162 | A1 | 11/2006 | Hanneman, Jr. et al. | |
| 2007/0062389 | A1 | 3/2007 | Link | |
| 2007/0199457 | A1 | 8/2007 | Cyman, Jr. et al. | |
| 2007/0199458 | A1 | 8/2007 | Cyman, Jr. et al. | |
| 2007/0199459 | A1 | 8/2007 | Cyman, Jr. et al. | |
| 2007/0199460 | A1 | 8/2007 | Cyman, Jr. et al. | |
| 2007/0199461 | A1 | 8/2007 | Cyman, Jr. et al. | |
| 2007/0199462 | A1 | 8/2007 | Cyman, Jr. et al. | |
| 2008/0011177 | A1 | 1/2008 | Muraoka | |
| 2008/0032072 | A1 | 2/2008 | Taniuchi et al. | |
| 2008/0202368 | A1 | 8/2008 | Kajitani et al. | |
| 2008/0223240 | A1 | 9/2008 | Drury et al. | |
| 2008/0271627 | A1 * | 11/2008 | Teng | B41C 1/1075 101/450.1 |
| 2009/0282995 | A1 | 11/2009 | Kosciesza | |
| 2010/0031838 | A1 | 2/2010 | Lewis et al. | |
| 2010/0251914 | A1 | 10/2010 | Zhou et al. | |
| 2011/0132213 | A1 * | 6/2011 | DeJoseph | B41C 1/1066 101/130 |
| 2012/0279408 | A1 * | 11/2012 | Ehrhardt | B41F 35/04 101/423 |

FOREIGN PATENT DOCUMENTS

| | | | |
|---|---|---|---|
| DE | 31 08 541 | A1 | 11/1982 |
| DE | 38 21 268 | A1 | 12/1989 |
| DE | 101 60 734 | A1 | 7/2002 |
| DE | 102 02 785 | A1 | 7/2003 |
| DE | 103 60 108 | A1 | 10/2004 |
| DE | 10 2006 050 744 | A1 | 4/2008 |
| DE | 10 2008 062 741 | A1 | 7/2010 |
| EP | 1 935 640 | A2 | 6/2008 |
| EP | 1 938 987 | A2 | 7/2008 |
| GB | 714326 | A | 8/1954 |
| GB | 719239 | A | 12/1954 |
| JP | 60-147339 | U | 9/1985 |
| WO | 03/070466 | A1 | 8/2003 |
| WO | 2006/133024 | A2 | 12/2006 |
| WO | 2009/025821 | A1 | 2/2009 |

OTHER PUBLICATIONS

Katano et al., "The New Printing System Using the Materials of Reversible Change of Wettability", International Congress of Imaging Science 2002, Tokyho, pp. 297 et seq. (2002).

Banks, W.H. "An Outline of Rheology in Printing," J. Rheologica Acta. pp. 272-275 (1965).

Kjelgaard, M. "Humidification Side by Side," Engineered Systems Mag., (Troy, MI 2002).

Turpin, J. "Ultrasonic Humidification is Ultra-Efficient," Engineered Systems Mag., (Troy, MI 2003).

European Search Report completed Mar. 30, 2012 for EP Application No. 11187196.8 (corresponding to U.S. Appl. No. 13/095,714, filed Apr. 27, 2011, to which this application claims priority).

European Search Report completed Oct. 24, 2013 for EP Application No. 12178607.3 (corresponding to U.S. Appl. No. 13/204,567, filed Aug. 5, 2011, to which this application claims priority).

* cited by examiner

VARIABLE DATA LITHOGRAPHY SYSTEM FOR APPLYING MULTI-COMPONENT IMAGES AND SYSTEMS THEREFOR

CROSS-REFERENCE TO RELATED APPLICATIONS

The present disclosure is a Divisional application of U.S. patent application Ser. No. 13/204,567, filed Aug. 5, 2011, and published as U.S. Patent Application Publication No. 20120274914 A1 on Nov. 1, 2012, which is in turn a Continuation-In-Part of U.S. patent application Ser. No. 13/095,714, filed Apr. 27, 2011, and published as U.S. Patent Application Publication No. 20120103212 A1 on May 3, 2012, entitled "Variable Data Lithography System", which claims benefit of U.S. Provisional Patent Applications Nos. 61/408,522, 61/408,554, and 61/408,556, all of which were filed Oct. 29, 2010, the disclosures of which are hereby incorporated by reference herein in their entireties.

BACKGROUND

The present disclosure is related to marking and printing methods and systems, and more specifically to methods and systems for variably marking or printing multi-component (e.g., multi-color) data using marking or printing materials such as UV lithographic and offset inks.

Offset lithography is a common method of printing today. (For the purposes hereof, the terms "printing" and "marking" are interchangeable.) In a typical lithographic process a printing plate, which may be a flat plate, the surface of a cylinder, or belt, etc., is formed to have "image regions" formed of hydrophobic and oleophilic material, and "non-image regions" formed of a hydrophilic material. The image regions are regions corresponding to the areas on the final print (i.e., the target substrate) that are occupied by a printing or marking material such as ink, whereas the non-image regions are the regions corresponding to the areas on the final print that are not occupied by said marking material. The hydrophilic regions accept and are readily wetted by a water-based fluid, commonly referred to as a fountain solution (typically consisting of water and a small amount of alcohol as well as other additives and/or surfactants to reduce surface tension). The hydrophobic regions repel fountain solution and accept ink, whereas the fountain solution formed over the hydrophilic regions forms a fluid "release layer" for rejecting ink. Therefore the hydrophilic regions of the printing plate correspond to unprinted areas, or "non-image areas", of the final print.

The ink may be transferred directly to a substrate, such as paper, or may be applied to an intermediate surface, such as an offset (or blanket) cylinder in an offset printing system. The offset cylinder is covered with a conformable coating or sleeve with a surface that can conform to the texture of the substrate, which may have surface peak-to-valley depth somewhat greater than the surface peak-to-valley depth of the imaging plate. Also, the surface roughness of the offset blanket cylinder helps to deliver a more uniform layer of printing material to the substrate free of defects such as mottle. Sufficient pressure is used to transfer the image from the offset cylinder to the substrate. Pinching the substrate between the offset cylinder and an impression cylinder provides this pressure.

In one variation, referred to as dry or waterless lithography or driography, the plate cylinder is coated with a silicone rubber that is oleophobic and patterned to form the negative of the printed image. A printing material is applied directly to the plate cylinder, without first applying any fountain solution as in the case of the conventional or "wet" lithography process described earlier. The printing material includes ink that may or may not have some volatile solvent additives. The ink is preferentially deposited on the imaging regions to form a latent image. If solvent additives are used in the ink formulation, they preferentially diffuse towards the surface of the silicone rubber, thus forming a release layer that rejects the printing material. The low surface energy of the silicone rubber adds to the rejection of the printing material. The latent image may again be transferred to a substrate, or to an offset cylinder and thereafter to a substrate, as described above.

The above-described lithographic and offset printing techniques utilize plates which are permanently patterned, and are therefore useful only when printing a large number of copies of the same image (long print runs), such as magazines, newspapers, and the like. However, they do not permit creating and printing a new pattern from one page to the next without removing and replacing the print cylinder and/or the imaging plate (i.e., the technique cannot accommodate true high speed variable data printing wherein the image changes from impression to impression, for example, as in the case of digital printing systems). Furthermore, the cost of the permanently patterned imaging plates or cylinders is amortized over the number of copies. The cost per printed copy is therefore higher for shorter print runs of the same image than for longer print runs of the same image, as opposed to prints from digital printing systems.

Lithography and the so-called waterless process provide very high quality printing, in part due to the quality and color gamut of the inks used. Furthermore, these inks—which typically have a very high color pigment content (typically in the range of 20-70% by weight)—are very low cost compared to toners and many other types of marking materials. Thus, while there is a desire to use the lithographic and offset inks for printing in order to take advantage of the high quality and low cost, there is also a desire to print variable data from page to page. Heretofore, there have been a number of hurdles to providing variable data printing using these inks. Furthermore, there is a desire to reduce the cost per copy for shorter print runs of the same image. Ideally, the desire is to incur the same low cost per copy of a long offset or lithographic print run (e.g., more than 100,000 copies), for medium print run (e.g., on the order of 10,000 copies), and short print runs (e.g., on the order of 1,000 copies), ultimately down to a print run length of 1 copy (i.e., true variable data printing).

One problem encountered is that offset inks have too high a viscosity (often well above 50,000 cps) to be useful in nozzle-based inkjet systems. In addition, because of their tacky nature, offset inks have very high surface adhesion forces relative to electrostatic forces and are therefore almost impossible to manipulate onto or off of a surface using electrostatics. (This is in contrast to dry or liquid toner particles used in xerographic/electrographic systems, which have low surface adhesion forces due to their particle shape and the use of tailored surface chemistry and special surface additives.)

Efforts have been made to create lithographic and offset printing systems for variable data in the past. One example is disclosed in U.S. Pat. No. 3,800,699, incorporated herein by reference, in which an intense energy source such as a laser to pattern-wise evaporate a fountain solution.

In another example disclosed in U.S. Pat. No. 7,191,705, incorporated herein by reference, a hydrophilic coating is applied to an imaging belt. A laser selectively heats and evaporates or decomposes regions of the hydrophilic coating. Next a water based fountain solution is applied to these hydrophilic regions rendering them oleophobic. Ink is then applied and selectively transfers onto the plate only in the areas not covered by fountain solution, creating an inked pattern that can be transferred to a substrate. Once transferred, the belt is cleaned, a new hydrophilic coating and fountain solution are deposited, and the patterning, inking, and printing steps are repeated, for example for printing the next batch of images.

In yet another example, a rewritable surface is utilized that can switch from hydrophilic to hydrophobic states with the application of thermal, electrical, or optical energy. Examples of these surfaces include so called switchable polymers and metal oxides such as $ZnO_2$ and $TiO_2$. After changing the surface state, fountain solution selectively wets the hydrophilic areas of the programmable surface and therefore rejects the application of ink to these areas.

There remain a number of problems associated with these techniques. A number of these problems are addressed by the aforementioned U.S. patent application Ser. No. 13/095,714. However, one limitation not otherwise adequately addressed in known systems for variable data lithography is that most such systems are able to produce only monochrome images. To the extent that any such system provides multicolor printing, it does so with multiple complete printing engines, one for each color, in a multiple impression process. Multiple color printing is highly desired, and for a number reasons including cost, complexity, servicing, size, energy consumption, and so on, a multiple print engine system is less than optimal.

SUMMARY

Accordingly, the present disclosure is directed to systems and methods for providing variable data lithographic and offset lithographic printing, which address the shortcomings identified above—as well as others as will become apparent from this disclosure. The present disclosure concerns various embodiments of a multiple color variable imaging lithographic marking system based upon variable patterning of dampening solutions and related methods.

In such a system, an imaging member, such as a drum, plate, belt, web, etc. is provided with a reimageable layer. This layer has specific properties such as composition, surface profile, and so on so as to be well suited for receipt and carrying a layer of a dampening fluid from a dampening fluid subsystem. An optical patterning subsystem such as a scanned, modulated laser patterns the dampening fluid layer, again with the characteristics of the reimageable layer chosen to facilitate this patterning. Ink is then applied at an inking subsystem such that it selectively resides in voids formed by the patterning subsystem in the dampening fluid layer to thereby form an inked latent image. The inked latent image is then transferred to a substrate, and the reimageable surface cleaned so that the process may be repeated. High speed, variable marking is thereby provided.

According to an aspect of the present disclosure, multiple inking subsystems are provided, each with different color ink. Each inking subsystem moves independently into and out of engagement with (i.e., proximate) the reimageable surface layer of the imaging member. The patterning subsystem creates a first pattern in dampening fluid, and the first inking subsystem engages with the reimageable surface to create a first color inked latent image, as described. This first color inked latent image is transferred to a substrate, for example at a transfer nip, and the reimageable surface layer of the imaging member cleaned. A second pattern is created in dampening fluid, the first inking subsystem disengages with the reimageable surface, and the second inking subsystem engages with the reimageable surface to create a second color inked latent image, as described. The substrate then makes another pass through the transfer nip so as to receive the second color inked latent image over the first. In a typical 4-color process, this pattern-engage-ink-print sequence may be repeated 4 times, once for each color. Indeed, it may be repeated more often if different color systems are used or different printing effects are desired.

According to another aspect of the disclosure, after transferring the first color inked latent image to the substrate, the image may be partially cured on the substrate to reduce smear, color transfer from the substrate back to the imagining member, and as subsequent color layers are added thereto. The partial cure may be from the back or front (or both) of the substrate, and be by way of UV exposure, heat, or other method appropriate to the particular ink and substrate being used. In one embodiment, the substrate is in the form of a sheet, such as paper, which is carried on a single drum from first to last pass. In other embodiments, other substrate handling mechanisms are employed.

According to still another aspect of the disclosure, a reimageable portion of one or more imaging members is provided. In one embodiment, the reimageable portion comprises a reimageable surface, for example composed of the class of materials commonly referred to as silicone (e.g., polydimethylsiloxane). The reimageable portion may contain or be formed over a structural material such as a cotton-weave core or other suitable material of sufficient tensile strength, or may be formed over a mounting layer composed of a suitable material such as a thin sheet of metal or cotton-weave backing or other suitable material of sufficient tensile strength. While it may be desirable for the reimageable surface layer to be relatively thin, from the point of view of material costs, etc., it is understood that thickness may be selected to improve other aspects of consideration such as performance, lifetime, and manufacturability. The reimageable portion may further comprise additional layers below the reimageable surface layer and either above or below structural mounting layer. Silicone is a preferred outer layer material because of its low surface energy (i.e., low "stickiness") which enhances release of the marking material, as will be described in further detail later on in this document. It is noted that the outer reimageable surface material may also be made from materials other than those primarily composed of silicone, which provide suitable low adhesion energy. Other examples of such materials include some types of hydrofluorocarbon compounds (e.g., Teflon, Viton, etc.) with long polymer chains of (—CF3) groups and fluorinated silicone hybrid compounds. It is known that surface materials that display a much larger receding to advancing wetting contact angle generally also display low adhesion energies to viscoelastic marking ink materials, and are therefore suitable materials for an outer layer. It is understood that the above-mentioned specific materials are representative examples only, and these examples should not be interpreted as limiting the scope of this invention to a specific class of materials.

According to another embodiment of this aspect of the disclosure, the reimageable surface layer or any of the underlying layers of the reimageable plate/belt/drum, etc. may incorporate a radiation sensitive filler material that can absorb laser energy or other highly directed energy in an efficient manner. Examples of suitable radiation sensitive materials are, for example, microscopic (e.g., average particle size less than 10 micrometers) to nanometer sized (e.g., average particle size less than 1000 nanometers) carbon black particles, carbon black in the form of nano particles of, single or multi-wall nanotubes, graphene, iron oxide nano particles, nickel plated nano particles, etc., added to the polymer in at least the near-surface region. It is also possible that no filler material is needed if the wavelength of a laser is chosen so to match an absorption peak of the molecules contained within the fountain solution or the molecular chemistry of the outer surface layer. As an example, a 2.94 μm wavelength laser would be readily absorbed due to the intrinsic absorption peak of water molecules at this wavelength.

Further according to this aspect, multiple print stages are provided, each printing a separate color. Each print stage may comprise its own imaging member with reimageable surface, dampening fluid subsystem, patterning subsystem, inking subsystem, partial curing subsystem, transfer nip, and cleaning subsystem. Alternatively, two or more of the multiple stages may share one or more of these subsystems. In a direct marking tandem embodiment, each imaging member sequentially transfers an inked color latent image to a substrate. In a central impression embodiment, each imaging member sequentially transfers an inked color latent image to a central impression drum, which then transfers the color composite image to a substrate.

It is understood that for the purposes of this invention, the terms "optical wavelengths" or "radiation" or "light" may refer to wavelengths of electromagnetic radiation appropriate for use in the system to accomplish patterning of the dampening solution, whether or not these electromagnetic wavelengths are normally visible to the unaided human eye, including, but not limited to, visible light, ultraviolet (UV), and infrared (IR) wavelengths, micro-wave radiation, and the like.

The above is a summary of a number of the unique aspects, features, and advantages of the present disclosure. However, this summary is not exhaustive. Thus, these and other aspects, features, and advantages of the present disclosure will become more apparent from the following detailed description and the appended drawings, when considered in light of the claims provided herein.

BRIEF DESCRIPTION OF THE DRAWINGS

In the drawings appended hereto like reference numerals denote like elements between the various drawings. While illustrative, the drawings are not drawn to scale. In the drawings.

DETAILED DESCRIPTION

We initially point out that description of well-known starting materials, processing techniques, components, equipment and other well-known details are merely summarized or are omitted so as not to unnecessarily obscure the details of the present invention. Thus, where details are otherwise well-known, we leave it to the application of the present invention to suggest or dictate choices relating to those details.

Figure 1:
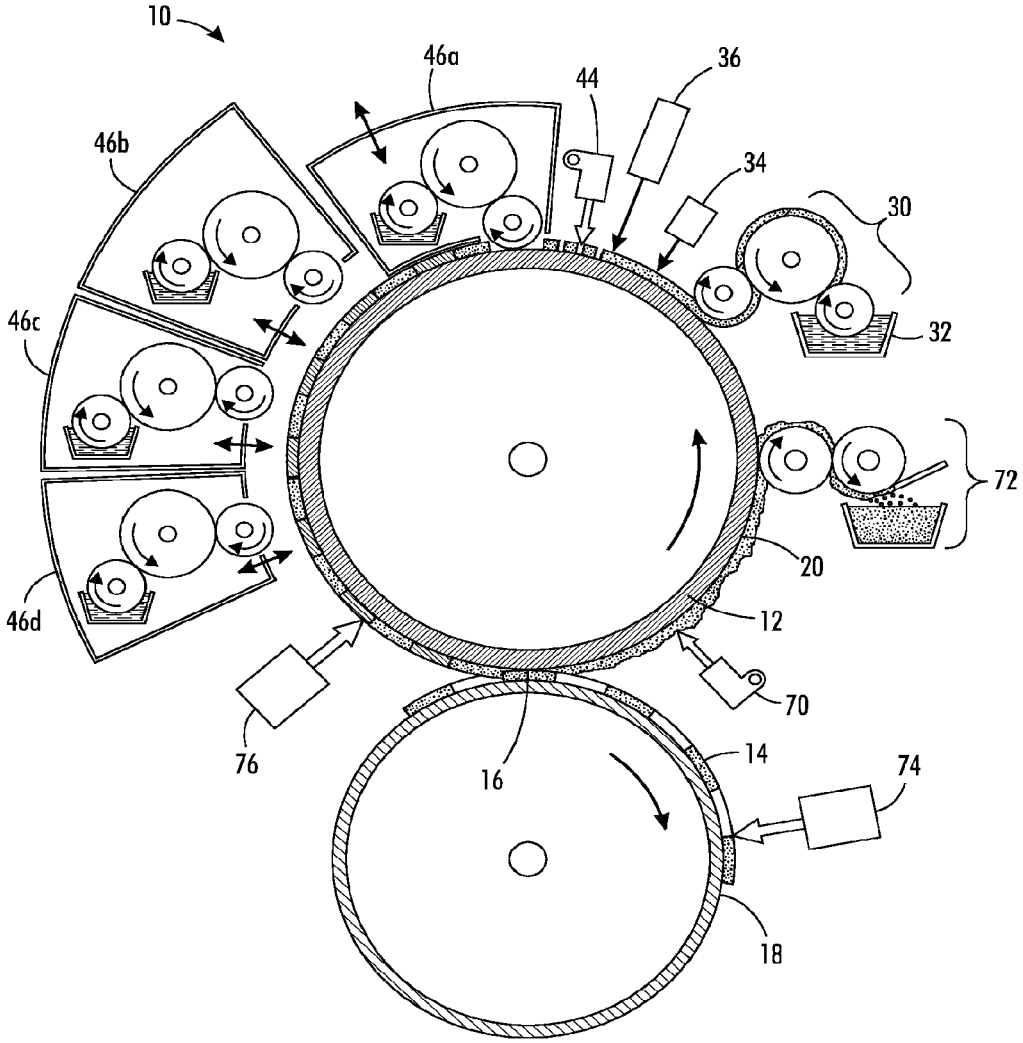
FIG. 1 is a side view of a system for multi-component variable lithography according to an embodiment of the present disclosure.

With reference to FIG. 1, there is shown therein a system 10 for multicolor variable lithography according to one embodiment of the present disclosure. System 10 comprises an imaging member 12, in this embodiment a drum, but may equivalently be a plate, belt, web, etc., surrounded by a number of subsystems described in detail below. Imaging member 12 applies an ink image to substrate 14 at nip 16 where substrate 14 is pinched between imaging member 12 and an impression roller 18. A wide variety of types of substrates, such as paper, plastic or composite sheet film, ceramic, glass, etc. may be employed. For clarity and brevity of this explanation we assume the substrate is paper, with the understanding that the present disclosure is not limited to that form of substrate. For example, other substrates may include cardboard, corrugated packaging materials, wood, ceramic tiles, fabrics (e.g., clothing, drapery, garments and the like), transparency or plastic film, metal foils, etc. A wide latitude of marking materials may be used including those with pigment densities greater than 10% by weight including but not limited to metallic inks or white inks useful for packaging. For clarity and brevity of this portion of the disclosure we generally use the term ink, which will be understood to include the range of marking materials such as inks, pigments, and other materials, which may be applied by systems and methods, disclosed herein.

Figure 2A:
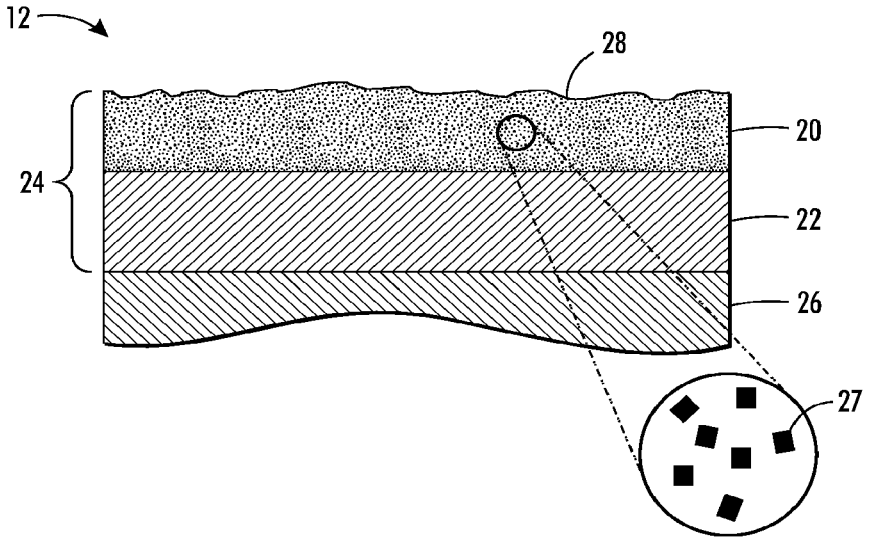
FIGS. 2A and 2B are cut-away side views of a reimaging portion of an imaging drum, plate or belt, without and with an intermediate layer, respectively, according to an embodiment of the present disclosure in which absorptive particulates are dispersed within a reimageable surface layer.
Figure 2B:
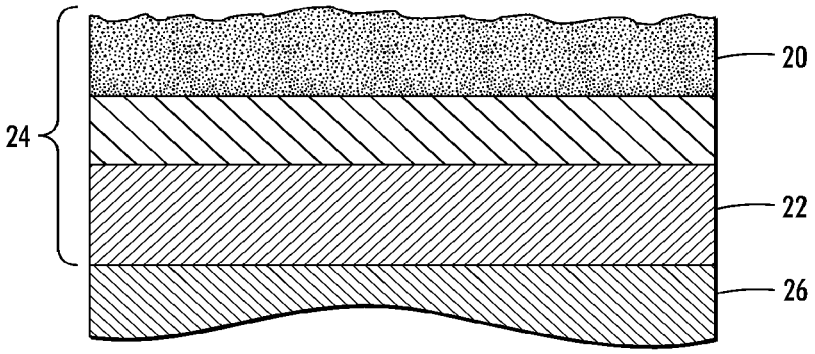

With reference to FIG. 2, a portion of imaging member 12 is shown in cross-section. In one embodiment, imaging member 12 comprises a thin reimageable surface layer 20 formed over a structural mounting layer 22 (for example metal, ceramic, plastic, etc.), which together forms a reimaging portion 24 that forms a rewriteable printing blanket. Reimaging portion 24 may further comprise additional structural layers, such as intermediate layer 21 shown in FIG. 2B, below reimageable surface layer 20 and either above or below structural mounting layer 22. Intermediate layer 21 may be electrically insulating (or conducting), thermally insulating (or conducting), have variable compressibility and durometer, and so forth. In one embodiment, intermediate layer 21 is composed of closed cell polymer foamed sheets and woven mesh layers (for example, cotton) laminated together with very thin layers of adhesive. Typically, blankets are optimized in terms of compressibility and durometer using a 3-4 ply layer system that is between 1-3 mm thick with a thin top surface layer 20 designed to have optimized roughness and surface energy properties. Reimaging portion 24 may take the form of a stand-alone drum or web, or a flat blanket wrapped around a cylinder core 26. In another embodiment the reimageable portion 24 is a continuous elastic sleeve placed over cylinder core 26. Flat plate, belt, web and other arrangements (which may or may not be supported by an underlying drum configuration) are also within the scope of the present disclosure. For the purposes of the following discussion, it will be assumed that reimageable portion 24 is carried by cylinder core 26, although it will be understood that many different arrangements, as discussed above, are contemplated by the present disclosure.

Reimageable surface layer 20 consists of a polymer such as polydimethylsiloxane (PDMS, or more commonly called silicone) for example with a wear resistant filler material such as silica to help strengthen the silicone and optimize its durometer, and may contain catalyst particles that help to cure and cross link the silicone material. Alternatively, silicone moisture cure (aka tin cure) silicone as opposed to catalyst cure (aka platinum cure) silicone may be used. Returning to FIG. 2A, reimageable surface layer 20 may optionally contain a small percentage of radiation sensitive particulate material 27 dispersed therein that can absorb laser energy highly efficiently. In one embodiment, radiation sensitivity may be obtained by mixing a small percentage of carbon black, for example in the form of microscopic (e.g., of average particle size less than 10 μm) or nanoscopic particles (e.g., of average particle size less than 1000 nm) or nanotubes, into the polymer. Other radiation sensitive materials that can be disposed in the silicone include graphene, iron oxide nano particles, nickel-plated nano particles, etc.

Figure 3:
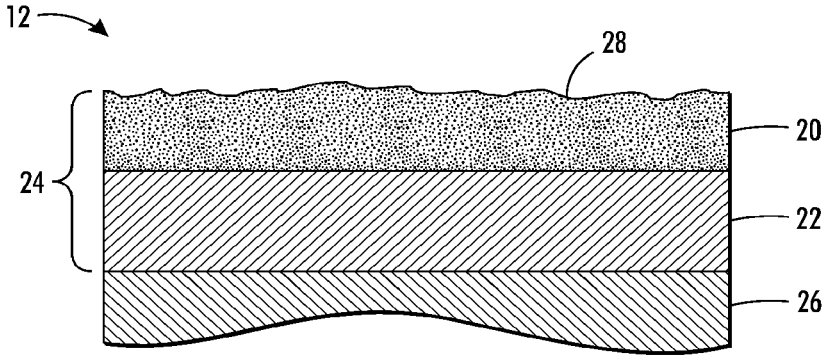
FIG. 3 is a cut-away side view of a reimaging portion of an imaging drum, plate or belt according to another embodiment of the present disclosure, in which a reimageable surface layer is tinted for optical absorption.
Figure 4:
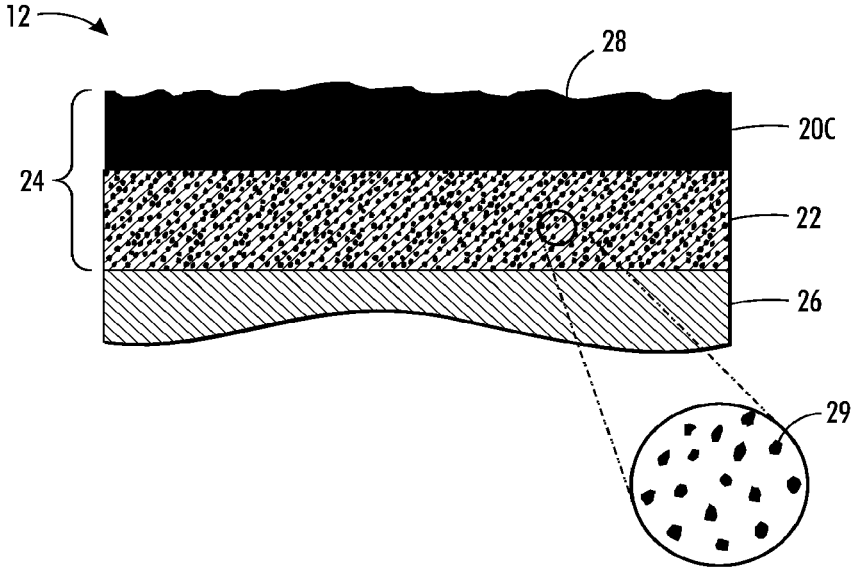
FIG. 4 is a cut-away side view of a reimaging portion of an imaging drum, plate or belt according to still another embodiment of the present disclosure, in which a reimageable surface layer it optically transparent or translucent, and is disposed over an optically absorptive layer.

Alternatively, reimageable surface layer 20 may be tinted or otherwise treated to be uniformly radiation sensitive, as shown in FIG. 3. Still further, reimageable surface layer 20 may be essentially transparent to optical energy from a source, described further below, and the structural mounting layer or layers 22 may be absorptive of that optical energy (e.g., layer 22 comprises a component that is at least partially absorptive), as illustrated in FIG. 4.

Reimageable surface layer 20 should have a weak adhesion force to the ink at the interface yet good oleophilic wetting properties with the ink, to promote uniform (free of pinholes, beads or other defects) inking of the reimageable surface and to promote the subsequent forward transfer lift off of the ink onto the substrate. Silicone is one material having this property. Other materials providing this property may alternatively be employed, such as certain blends of polyurethanes, fluorocarbons, etc. In terms of providing adequate wetting of dampening solutions (such as water-based fountain fluid), the silicone surface need not be hydrophilic but in fact may be hydrophobic because wetting surfactants, such as silicone glycol copolymers, may be added to the dampening solution to allow the dampening solution to wet the silicone surface.

It will therefore be understood that while a water-based solution is one embodiment of a dampening solution that may be employed in the embodiments of the present disclosure, other non-aqueous dampening solutions with low surface tension, that are oleophobic, are vaporizable, decomposable, or otherwise selectively removable, etc. may be employed. One such class of fluids is the class of Hydro-FluoroEthers (HFE), such as the Novec brand Engineered Fluids manufactured by 3M of St. Paul, Minn. These fluids have the following beneficial properties in light of the current disclosure: (1) much lower heat of vaporization than water, which translates into lower laser power required for a given print speed, or higher print speed for a given laser power, when an optical laser is used to selectively vaporize the dampening solution to form the latent image; (2) lower heat capacity, which translates into the same benefits; (3) they leave substantially no solid residue after evaporation, which can translate into relaxed cleaning requirements and/or improved long-term stability; (4) vapor pressure and boiling point can be engineered, which can translate into an improved robustness of a spatially selective forced evaporation process; (5) they have a low surface energy, as required for proper wetting of the imaging member; and, (6) they are benign in terms of the environment and toxicity. Additional additives may be provided to control the electrical conductivity of the dampening solution. Other suitable alternatives include fluorinerts and other fluids known in the art, that have all or a majority of the above properties. It is also understood that these types of fluids may not only be used in their undiluted form, but as a constituent in an aqueous non-aqueous solution or emulsion as well.

In addition, the surface energy of silicone may be optimized to provide good wetting properties by controlling and specifying precise amounts of filler nano particles in the silicone as well as the exact chemistry of the silicone material, which can be composed of different distributions of polymer chain lengths and end group capping chemistries. For example, it has been found that single component moisture cure silicones that are tin catalyzed with low concentrations of silica filler have dispersive surface energies between 24-26 dynes/cm. Certain additives may also be added to the marking material in order to dramatically reduce the surface tension of the marking material and improve its surface wetting properties to the silicone. These additives could include, for example, leveling agents based on known copolymer fluoro or silicone chemistries that also incorporate other polymer groups for easy dispersion and curing. For example, leveling agents that can reduce ink surface tension to 21 dynes/cm.

If silicone is used as the reimageable surface layer 20, other particles 27 may also be embedded within layer 20 to help catalyze the curing and cross linking of the silicone.

Figure 5A:
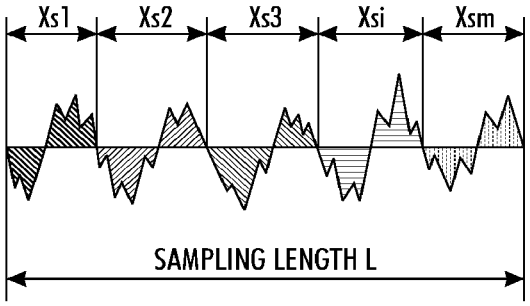
FIGS. 5A and 5B are illustrations of imaging surface texture feature spacings and feature amplitudes for the purposes of defining RSm and Ra, respectively.
Figure 5B:
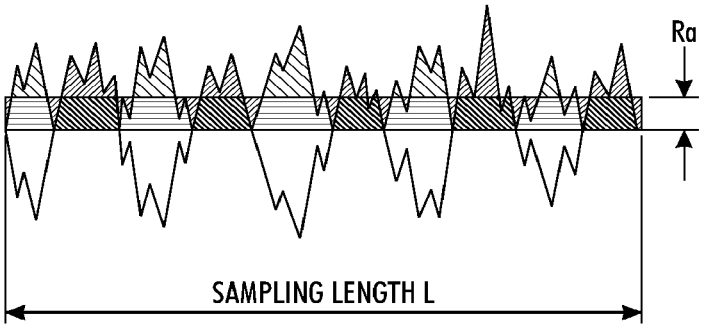

According to one embodiment, reimageable surface layer 20 has roughness on the order of the desired dampening solution layer thickness to better trap the dampening solution and prevents its spreading beyond the desired non-imaging region boundaries. For example, reimageable surface layer 20 may have measured surface roughness characteristics RSm and Ra defined as:

$$RSm = \frac{1}{m}\sum_{i=1}^{m} Xsi$$

and with reference to FIGS. 5A and 5B wherein RSm is defined as the mean value of the profile element width X(s) within a sample length L and Ra is related to averaged peak to average baseline measurements over a sample length L. Thus, RSm is characteristic of the peak-to-peak spacing and Ra is characteristic of the peak height. Such definitions can be extended over two dimensions by using a characteristic sampling area A with dimensions $A \sim L^2$.

It is desirable that the peaks and valleys are somewhat randomly distributed to reduce the possibility of Moiré interference with a linescreen pattern. In addition, it is desirable that the spatial distance between the peaks is somewhat less than the smallest line screen dot size, for example less than 10 μm. This roughness helps the surface to easily retain dampening solution while eliminating Moiré effects and acts to improve inking uniformity and transfer, as described further below. In one embodiment RSm is less than about 20 μm and the Ra is less than about 4.0 μm, and in a more specific embodiment, RSm is less than 10 μm and the Ra is between 0.1 μm and 4.0 μm.

In addition, the reimageable surface layer 20 must be wear resistant and capable of some flexibility (even under tension) in order to transfer ink off of its surface onto porous or rough paper media uniformly. The reimageable surface layer 20 may be made thick enough to achieve an appropriate elasticity and durometer and sufficient flexibility necessary for coating ink over different media types with different levels of roughness. Of course, systems may be designed for printing to a specific media type, obviating the need to accommodate a variety of media types. In one embodiment the thickness of the silicone layer forming reimageable surface layer 20 is in the range of 0.5 μm to 4 mm.

Finally, reimageable surface layer 20 must facilitate the flow of ink onto its surface with uniformity and without beading or dewetting. Various materials such as silicone can be manufactured or textured to have a range of surface energies, and such energies can be tailored with additives. Reimageable surface layer 20, while nominally having a low value of dynamic chemical adhesion, may have a sufficient surface energy in order to promote efficient ink wetting/affinity without ink dewetting or beading.

Returning to FIG. 1, disposed at a first location around imaging member 12 is dampening solution subsystem 30. Dampening solution subsystem 30 generally comprises a series of rollers (referred to as a dampening unit) for uniformly wetting the surface of reimageable surface layer 20. It is well known that many different types and configurations of dampening units exist. The purpose of the dampening unit is to deliver a layer of dampening solution 32 having a uniform and controllable thickness. In one embodiment this layer is in the range of 0.2 μm to 1.0 μm, and very uniform without pinholes. The dampening solution 32 may be composed mainly of water, optionally with small amounts of isopropyl alcohol or ethanol added to reduce its natural surface tension as well as lower the evaporation energy necessary for subsequent laser patterning. In addition, a suitable surfactant is ideally added in a small percentage by weight, which promotes a high amount of wetting to the reimageable surface layer 20. In one embodiment, this surfactant consists of silicone glycol copolymer families such as trisiloxane copolyol or dimethicone copolyol compounds which readily promote even spreading and surface tensions below 22 dynes/cm at a small percentage addition by weight. Other fluorosurfactants are also possible surface tension reducers. Optionally dampening solution 32 may contain a radiation sensitive dye to partially absorb laser energy in the process of patterning, described further below.

In addition to or in substitution for chemical methods, physical/electrical methods may be used to facilitate the wetting of dampening solution 32 over the reimageable surface layer 20. In one example, electrostatic assist operates by way of the application of a high electric field between the dampening roller and reimageable surface layer 20 to attract a uniform film of dampening solution 32 onto reimageable surface layer 20. The field can be created by applying a voltage between the dampening roller and the reimageable surface layer 20 or by depositing a transient but sufficiently persisting charge on the reimageable surface layer 20 itself. The dampening solution 32 may be electronically conductive. Therefore, in this embodiment an insulating layer (not shown) may be added to the dampening roller and/or under reimageable surface layer 20. Using electrostatic assist, it may be possible to reduce or eliminate the surfactant from the dampening solution.

Following metering of dampening solution 32 onto reimageable surface layer 20 by dampening solution subsystem 30, the thickness of the metered dampening solution may be measured using a sensor 34 such as an in-situ non-contact laser gloss sensor or laser contrast sensor, such as those sold by Wenglor Sensors (Beavercreek, Ohio). Such a sensor can be used to automate the controls of dampening solution subsystem 30.

After applying a precise and uniform amount of dampening solution, in one embodiment an optical patterning subsystem 36 is used to selectively form a latent image in the dampening solution by image-wise evaporating the dampening solution layer using laser energy, for example. It should be noted here that the reimageable surface layer 20 should ideally absorb most of the energy as close to an upper surface 28 (FIG. 2) as possible, to minimize any energy wasted in heating the dampening solution and to minimize lateral spreading of the heat so as to maintain high spatial resolution capability. Alternatively, it may also be preferable to absorb most of the incident radiant (e.g., laser) energy within the dampening solution layer itself, for example, by including an appropriate radiation sensitive component within the dampening solution that is at least partially absorptive in the wavelengths of incident radiation, or alternatively by choosing a radiation source of the appropriate wavelength that is readily absorbed by the dampening solution (e.g., water has a peak absorption band near 2.94 micrometer wavelength).

It will be understood that a variety of different systems and methods for delivering energy to pattern the dampening solution over the reimageable surface may be employed with the various system components disclosed and claimed herein. However, the particular patterning system and method do not limit the present disclosure.

Figure 6:
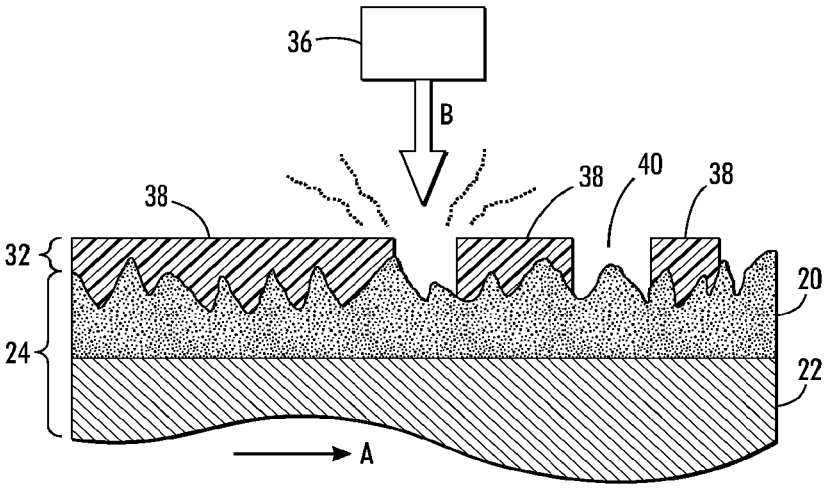
FIG. 6 is a magnified cut-away side view of the reimaging portion shown in FIG. 2, having a dampening solution applied thereover and patterned by a beam B, according to an embodiment of the present disclosure.

With reference to FIG. 6, which is a magnified view of a region of reimageable portion 24 having a layer of dampening solution 32 applied over reimageable surface layer 20, the application of optical patterning energy (e.g., beam B) from optical patterning subsystem 36 results in selective evaporation of portions the layer of dampening solution 32. Evaporated dampening solution becomes part of the ambient atmosphere surrounding system 10. This produces a pattern of dampening solution regions 38 and ink receiving voids 40 over reimageable surface layer 20. Relative motion between imaging member 12 and optical patterning subsystem 36, for example in the direction of arrow A, permits a process-direction patterning of the layer of dampening solution 32.

Returning to FIG. 1, following patterning of the dampening solution layer 32, one of a series of inker subsystems 46*a*, 46*b*, 46*c*, 46*d* is used to apply a uniform layer 48 of ink, shown in FIG. 6, over the layer of dampening solution 32 and reimageable surface layer 20. It will be understood that marking materials beyond inks (such as non-aqueous marking material, finishing materials, surface treatments, etc.), whether visible or non-visible, may be utilized in the embodiments disclosed herein. Thus, while "marking material applicator" may be more general and comprehensive the term "inker" subsystem is employed in the following descriptions for ease of reference. Four inker subsystems are shown in FIG. 1, each corresponding with a color component such as cyan, magenta, yellow, and black of a color system. Alternatively, system 10 may comprise additional or fewer inker subsystems as may be appropriate for alternative color systems, printing effects, and so. Incorporation of such additional, or fewer, inker subsystems will be readily understood by one skilled in the art from the present disclosure. While for the purposes of this example each inker subsystem is assumed to deposit different color ink, in variations contemplated hereby each inker subsystem may deposit a marking material that may differ in other than (just) color. For example, as between two such inker subsystems, one may deposit a flat finish of a color while the other may deposit a reflective finish of that same color (possibly in a different pattern as between the two). One may deposit standard ink, while the second deposits magnetically readable ink. One may again deposit standard ink, while the second deposits a uniform surface finish coat, etc. Therefore, the actual material deposited does not per se limit the scope of the methods and systems disclosed and claimed herein.

Optionally, an air knife 44 may be directed towards reimageable surface layer 20. Air knife 44 may control airflow over the surface layer before the inking subsystems for the purpose of maintaining clean dry air supply, a controlled air temperature and reducing dust contamination.

Each inker subsystem 46*a*, 46*b*, 46*c*, 46*d* may consist of a "keyless" system using an anilox roller to meter an offset ink onto one or more forming rollers. Alternatively, each inker subsystem 46*a*, 46*b*, 46*c*, 46*d* may consist of more traditional elements with a series of form rollers that use electromechanical keys to determine the precise feed rate of the ink. The general aspects of inker subsystem architecture will depend on the application of the present disclosure, and will be well understood by one skilled in the art.

Figure 8:
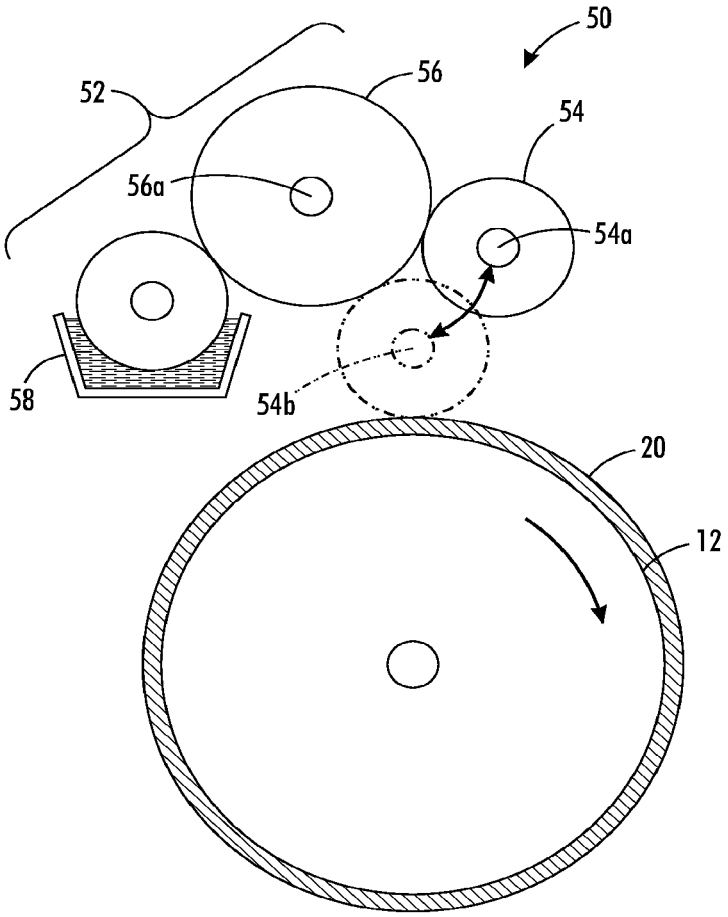
FIG. 8 is a side view of an inker subsystem used to apply a uniform layer of ink over a patterned layer of dampening solution and portions of a reimageable surface layer exposed by the patterning of the dampening solution, according to an embodiment of the present disclosure.

Each inker subsystem 46*a*, 46*b*, 46*c*, 46*d* may be actuated to engage with or disengage from reimageable surface 20. By engage, it is meant that the inker subsystem, or a component thereof, is positioned proximate the reimageable surface such that material carried thereby is permitted to be transferred onto the reimageable surface. This may or may not mean physical contact between the two, depending on many factors. Similarly, disengagement is meant the positioning of the inker subsystem, or a component thereof, such that material carried thereby cannot readily transfer therefrom to the reimageable surface. In the embodiment illustrated in FIG. 1, each inker subsystem may translate on a track or armature generally radially with regard to imaging member 12. Many other embodiments are within the scope of the present disclosure for engaging and disengaging the inker subsystems with reimageable surface 20. One such alternative embodiment 50 is illustrated in FIG. 8. Embodiment 50 comprises an inking subsystem 52 including a rotationally disposed metering (forming) roller 54, which receives ink from anilox roller 56, and which selectively transfers ink to reimageable surface 20 of imaging member 12. Form roller 54 rotates around a central axis that, in a first position 54*a*, is such that the surface of form roller 54 is not engaged with reimageable surface 20. The center of rotation of form roller 54 may be translated to a second position 54*b*, such as rotating around a center 56*a* of anilox roller 56, such that the surface of form roller 54 is engaged with reimageable surface 20. In this way, ink from a reservoir 58 is applied to reimageable surface 20 when form roller 54 is engaged with reimageable surface 20, and is not applied to reimageable surface 20 when form roller 54 is disengaged from reimageable surface 20.

Returning to FIG. 6, in order for ink from inker subsystem 46 to initially wet over the reimageable surface layer 20, the ink must have low enough cohesive energy to split onto the exposed portions of the reimageable surface layer 20 (ink receiving dampening solution voids 40) and also be hydrophobic enough to be rejected at dampening solution regions 38. Since the dampening solution is low viscosity and oleophobic, areas covered by dampening solution naturally reject all ink because splitting naturally occurs in the dampening solution layer that has very low dynamic cohesive energy. In areas without dampening solution, if the cohesive forces between the ink are sufficiently lower than the adhesive forces between the ink and the reimageable surface layer 20, the ink will split between these regions at the exit of the forming roller nip. The ink employed should therefore have a relatively low viscosity in order to promote better filling of voids 40 and better adhesion to reimageable surface layer 20. For example, if an otherwise known UV ink is employed, and the reimageable surface layer 20 is comprised of silicone, the viscosity and viscoelasticity of the ink will likely need to be modified slightly to lower its cohesion and thereby be able to wet the silicone. Adding a small percentage of low molecular weight monomer or using a lower viscosity oligomer in the ink formulation can accomplish this rheology modification. In addition, wetting and leveling agents may be added to the ink in order to further lower its surface tension in order to better wet the silicone surface.

In addition to this rheological consideration, it is also important that the ink composition maintain a hydrophobic character so that it is rejected by dampening solution regions 38. This can be maintained by choosing offset ink resins and solvents that are hydrophobic and have non-polar chemical groups (molecules). When dampening solution covers layer 20, the ink will then not be able to diffuse or emulsify into the dampening solution quickly and because the dampening solution is much lower viscosity than the ink, film splitting occurs entirely within the dampening solution layer, thereby rejecting ink any ink from adhering to areas on layer 20 covered with an adequate amount of dampening solution. In general, the dampening solution thickness covering layer 20 may be between 0.1 μm-4.0 μm, and in one embodiment 0.2 μm-2.0 μm depending upon the exact nature of the surface texture.

Figure 7:
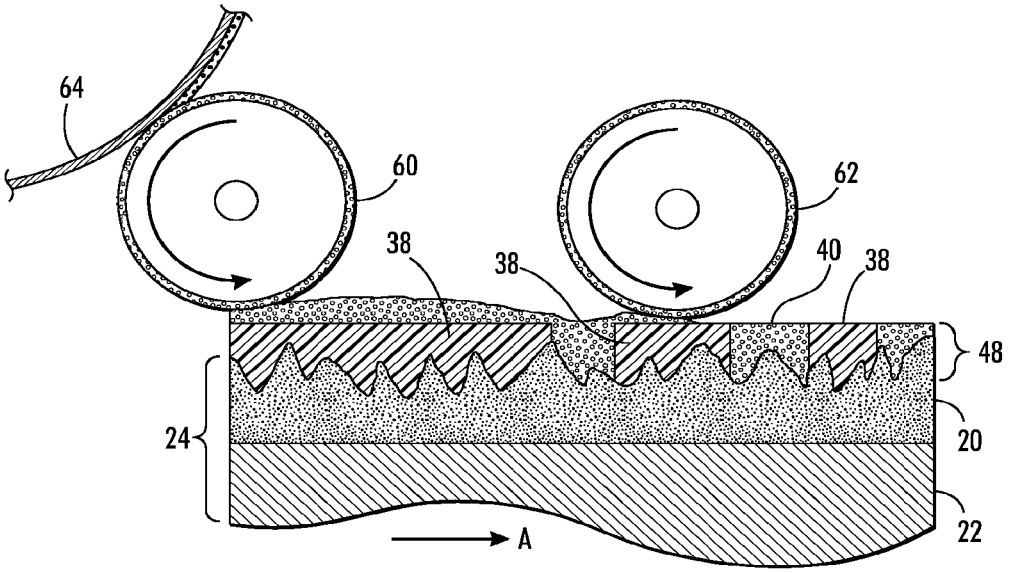
FIG. 7 is a side view of an inker subsystem having a rotationally disposed metering (forming) roller, which receives ink from a source roller, for selectively transferring ink to a reimageable surface, according to an embodiment of the present disclosure.

In certain embodiments, a metering roller 62 may be employed with a form roller 60, such as illustrated in FIG. 7. The thickness of the ink coated on roller 60 from a source roller 64, such as an anilox roller, and optional roller 62 can be controlled by adjusting the feed rate of the ink through the roller system using distribution rollers, adjusting the pressure between feed roller, form roller 60, and form roller 62, and by using ink keys to adjust the flow off of an ink tray. Ideally, the thickness of the ink presented to the rollers 60, 62 should be at least twice the final thickness desired to transfer to the reimageable layer 20 as film splitting occurs. It is also possible to use a keyless system which can control the overall ink film thickness by using an anilox roller with uniformly formed ink carrying pits and maintaining the temperature to achieve the desired ink viscosity. Typically, the final film thickness may be approximately 1-2 μm.

Ideally, an optimized ink system splits onto the reimageable surface at a ratio of approximately 50:50 (i.e., 50% remains on the ink forming rollers and 50% is transferred to the reimageable surface at each pass). However, other splitting ratios may be acceptable as long as the splitting ratio is well controlled. For example, for 70:30 splitting, the ink layer over reimageable surface layer 20 is 30% of its nominal thickness when it is present on the outer surface of the forming rollers. It is well known that reducing an ink layer thickness reduces its ability to further split. This reduction in thickness helps the ink to come off from the reimageable surface very cleanly with residual background ink left behind. However, the cohesive strength or internal tack of the ink also plays an important role.

Returning to FIG. 1, a first inker subsystem, such as subsystem 46*a*, is engaged with reimageable surface 20 such that ink of a first color provided by that inker subsystem is applied to the reimageable surface in regions of voids in the dampening fluid layer provided thereover and thereby form an inked latent image of the first color. The inked latent image of the first color is next transferred to substrate 14 such as by passing substrate 14 through nip 16 between imaging member 12 and impression roller 18. Adequate pressure is applied between imaging member 12 and impression roller 18 such that the ink within voids 40 (FIG. 8) is brought into physical contact with substrate 14. Adhesion of the ink to substrate 14 and strong internal cohesion cause the ink to separate from reimageable surface layer 20 and adhere to substrate 14. Impression roller or other elements of nip 16 may be cooled to further enhance the transfer of the inked latent image to substrate 14. Indeed, substrate 14 itself may be maintained at a relatively colder temperature than the ink on imaging member 12, or locally cooled, to assist in the ink transfer process. The ink can be transferred off of reimageable surface layer 20 with greater than 95% efficiency as measured by mass, and can exceed 99% efficiency with system optimization.

Substrate 14 may be maintained within the system in a position such that it may readily be reintroduced to nip 16 for successive passes, each layering a color latent ink image thereon. More specifically, any residual ink and residual dampening solution remaining on reimageable surface 20 after nip 16 must be removed, preferably without scraping or wearing that surface. Much of the dampening solution can be easily and quickly removed using an air knife 70 with sufficient airflow. Removal of remaining ink is accomplished at cleaning subsystem 72. The application of dampening fluid and patterning of the dampening fluid, as previously described is repeated. A new pattern is thereby formed in the dampening fluid layer. Inker subsystem 46*a* is disengaged from reimageable surface 20, and inker subsystem 46*b* moved to engage reimageable surface 20. A second color ink may thereby be applied to the patterned dampening fluid layer over reimageable surface 20 to form a latent ink image of the second color. This latent ink image of the second color is transferred to substrate 14 such as by passing substrate 14 through nip 16 between imaging member 12 and impression roller 18. One of a variety of methods for registration of substrate 14 for receipt of the latent ink image of the second color, description of which being beyond the scope of the present disclosure, is employed to ensure the registration of the two latent images. This process is similarly repeated for inker subsystems 46*c* and 46*d*.

To assist in preventing smearing, color contamination, color transfer from the substrate back to the imagining member, and so on, following transfer of one inked color latent image to the substrate, the image may be partially cured. The partial cure may be from the back or front (or both) of the substrate, and be by way of UV exposure, heat, or other source 74 appropriate to the particular ink and substrate being used. In addition, the ink may be partially cured on reimageable surface 20 prior to transfer to substrate 14, such as by a UV, heat, or other source 76.

Figure 9:
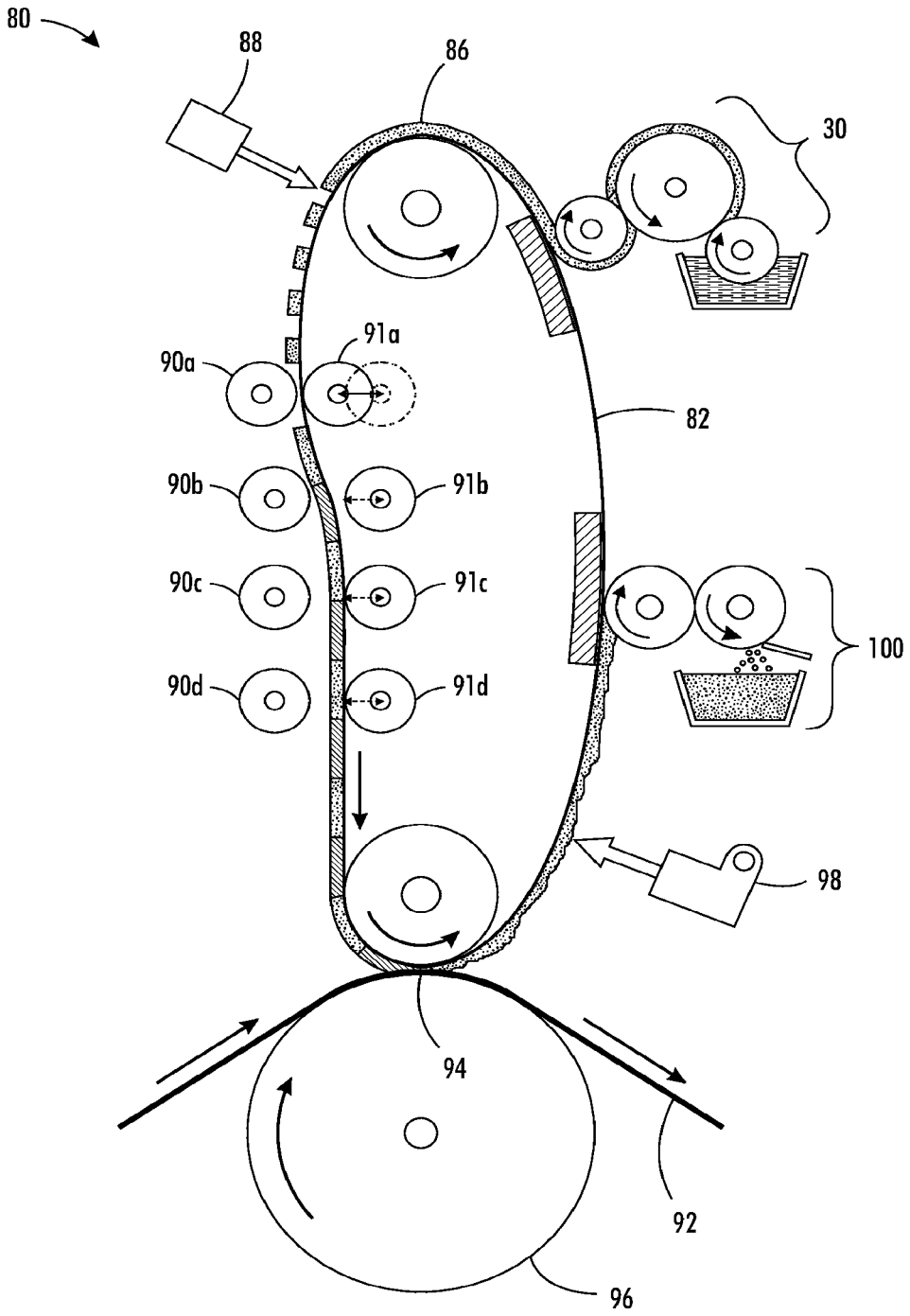
FIG. 9 is a side view of a system for multicolor variable lithography according to another embodiment of the present disclosure.

In an exemplary embodiment, substrate 14 is retained on the surface of impression roller 18 for each of the passes through nip 16. The rotation of imaging member 12 and impression roller 18 are synchronized to ensure the aforementioned registration. Substrate 14 makes up to n revolutions (n being, for example, the number of inker subsystems) and is then removed from the impression roller 18. According to another embodiment 80 illustrated in FIG. 9, in place of imparting each latent color image directly to substrate 14, they are successively applied to belt 82 (a web, plate or other intermediate member may similarly be employed).

Other modes of indirect transferring of the ink pattern from an imaging member to a substrate are also contemplated by this disclosure. For example, with reference to FIG. 9, an alternate embodiment 80 of the present disclosure comprises a low mass, relatively flexible belt or web image receiving member 82 having a reimageable surface thereover. Similar to the embodiments described above, a dampening system 84 applies a layer of dampening fluid 86 over the surface of image receiving member 82. One of a variety of methods and systems may be employed to ensure that the layer of dampening fluid is of a uniform and desired thickness. The dampening fluid layer is patterned by a patterning subsystem 88, for example, a scanned and modulated laser source. A plurality of inker subsystems 90*a*, 90*b*, 90*c*, 90*d*, etc., are positioned proximate but not in a touching relationship to the reimageable surface of imaging member 82. Imaging member 82 is relatively flexible. A plurality of engagement mechanisms 91*a*, 91*b*, 91*c* 91*d*, etc. is disposed opposite inker subsystems 90*a*, 90*b*, 90*c*, 90*d*, etc. with imaging member 82 disposed therebetween. Each engagement mechanism 91*a*, 91*b*, 91*c*, 91*d*, etc. is individually translatable so as to deflect imaging member 82 into engagement with a corresponding one of inker subsystems 90*a*, 90*b*, 90*c*, 90*d*, etc., which may apply ink thereto. Thus, for example, with engagement mechanism 91*a* deflecting imaging member 82 into engagement with inker subsystem 90*a*, as shown, ink of a first color or composition may be applied to the reimageable surface of imaging member 82. As explained above, this ink preferentially deposits in the voids formed by patterning subsystem 88 to form an inked color latent image on the surface of imaging member 82.

The inked color latent image is transferred to substrate 92 such as by passing substrate 92 through nip 94 between imaging member 82 and impression roller 96. Partial curing other aspects of image optimization and maintaining substrate 92 in position for successive passes for image application may be performed.

Any residual ink and residual dampening solution remaining on the reimageable surface of imaging member 82 after nip 94 is removed using an air knife 98 in combination with a cleaning subsystem 100 (or other suitable cleaning methods and subsystems). The application of dampening fluid and patterning of the dampening fluid, as previously described, is repeated. A new pattern is thereby formed in the dampening fluid layer. Engagement member 91*a* is refracted, and engagement 91*b* activated so as to deflect the reimageable surface of imaging member 82 into engagement with inker subsystem 90*b*. A second color ink may thereby be applied by inker subsystem 90*b* to the patterned dampening fluid layer over the reimageable surface of imaging member 82 to form a latent ink image of the second color. This latent ink image of the second color is transferred to substrate 92. This process is similarly repeated for inker subsystems 90*c* and 90*d*.

While the aforementioned embodiments have primarily involved multi-pass printing according to which colors are successively applied to a patterned intermediate transfer member and transferring that color pattern to the substrate, cleaning the intermediate transfer member, in certain embodiments it may be desirable to successively transfer individual color images directly to a substrate. Such may be the case, for example, where the substrate is continuous or longer than the circumference of the impression roller, where it is not practical to retain a substrate and reintroduce it through a nip successive times, etc.

Figure 10:
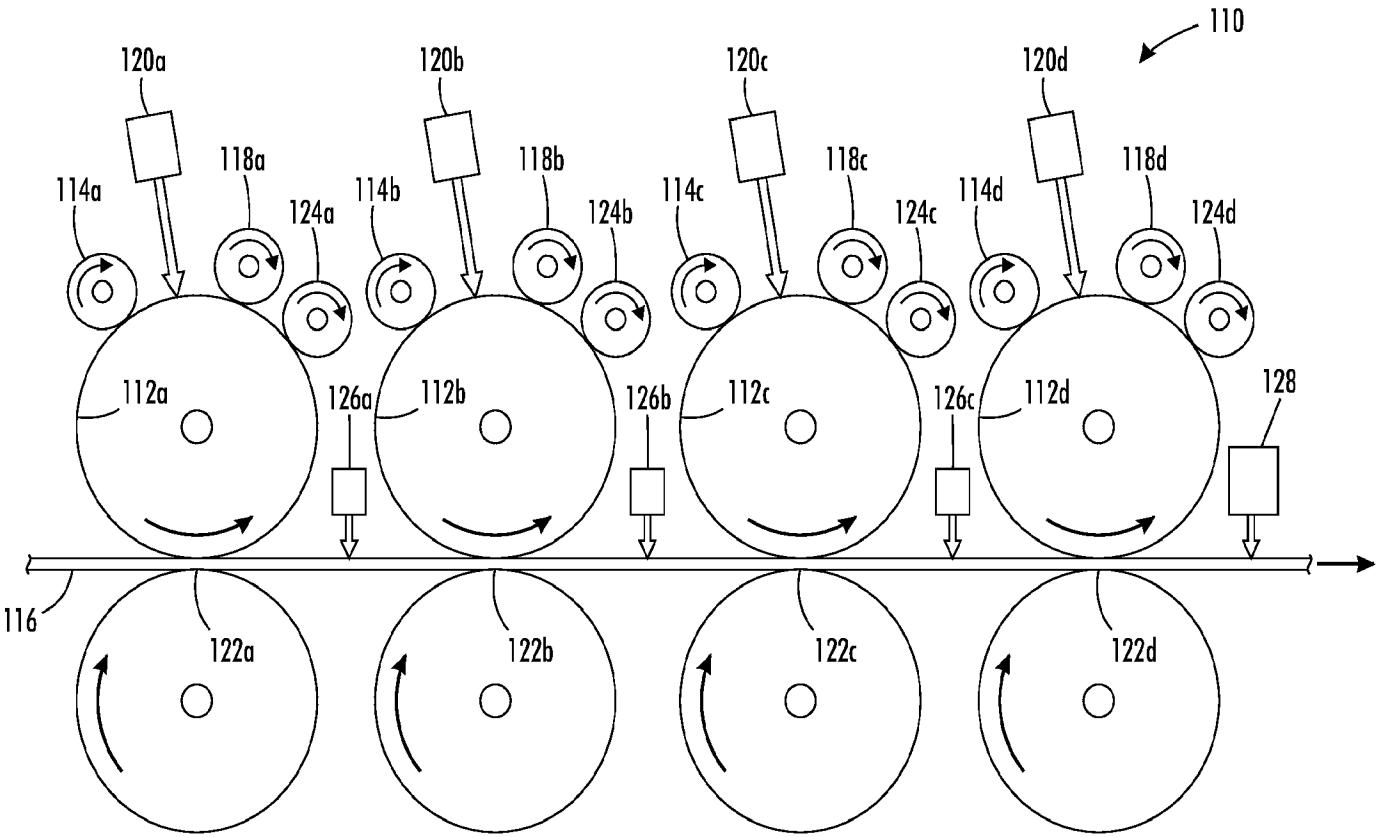
FIG. 10 is a side view of a tandem architecture system for multi-component variable lithography according to an embodiment of the present disclosure.

With reference next to FIG. 10, a tandem architecture embodiment 110 is shown for multicolor variable data lithography directly to a substrate. According to embodiment 110, a plurality of imaging members 112*a*, 112*b*, 112*c*, 112*d*, etc., each having associated therewith an inker subsystem 114*a*, 114*b*, 114*c*, 114*d*, etc. for example of a different color, are arranged to engage a substrate 116 traveling in proximity thereto. Essentially as previously discussed, each imaging member 112*a*, 112*b*, 112*c*, 112*d* comprises a reimageable layer thereover for receiving dampening fluid from a dampening fluid subsystem 118*a*, 118*b*, 118*c*, 118*d*, etc., respectively. The dampening fluid layer over each reimageable surface is patterned by a patterning subsystem 120*a*, 120*b*, 120*c*, 120*d*, etc., respectively. Each of inker subsystems 114*a*, 114*b*, 114*c*, 114*d*, etc. apply a unique ink material (e.g., different color, different ink composition, different opacity, etc.) over the patterned dampening fluid layer to form a unique latent image over each imaging member 112*a*, 112*b*, 112*c*, 112*d*, etc. In succession, each unique latent image is applied to substrate 116 at nips 122*a*, 122*b*, 122*c*, 122*d*, etc. Each reimageable surface may then be cleaned at cleaning subsystem 124*a*, 124*b*, 124*c*, 124*d*, etc. Optionally, after each imaging member 112*a*, 112*b*, 112*c*, 112*d*, etc. applies its latent image to substrate 116, the image on substrate 116 may be at least partially cured by curing subsystems 126*a*, 126*b*, 126*c*, etc. (such as UV curing for UV-cured inks) A full UV cure (or other material treatment) subsystem 128 may also be provided following the last application of ink.

While in such embodiments it has been assumed that each imaging member comprises a reimageable substrate that is provided with its own dampening fluid layer that is patterned and inked, in certain embodiments one or more of the imaging members may carry a permanent image pattern that is inked and added to the intermediate or final substrate together with an image(s) from a reimageable surface of an imaging member. In this way, variable and non-variable print elements may be combined prior to or onto a substrate.

A system having a single imaging cylinder, without an offset or blanket cylinder, is shown and described herein. The reimageable surface layer is made from material that is conformal to the roughness of print media via a high-pressure impression cylinder, while it maintains good tensile strength necessary for high volume printing. Traditionally, this is the role of the offset or blanket cylinder in an offset printing system. However, requiring an offset roller implies a larger system with more component maintenance and repair/replacement issues, and increased production cost, added energy consumption to maintain rotational motion of the drum (or alternatively a belt, plate or the like). Therefore, while it is contemplated by the present disclosure that an offset cylinder may be employed in a complete printing system, such need not be the case. Rather, the reimageable surface layer may instead be brought directly into contact with the substrate to affect a transfer of an ink image from the reimageable surface layer to the substrate. Component cost, repair/replacement cost, and operational energy requirements are all thereby reduced.

It should be understood that when a first layer is referred to as being "on" or "over" a second layer or substrate, it can be directly on the second layer or substrate, or on an intervening layer or layers may be between the first layer and second layer or substrate. Further, when a first layer is referred to as being "on" or "over" a second layer or substrate, the first layer may cover the entire second layer or substrate or a portion of the second layer or substrate.

The invention described herein, when operated according to the method described herein meets the standard of high ink transfer efficiency, for example greater than 95% and in some cases greater than 99% efficiency of transferring ink off of the imaging member and onto the substrate. In addition, the disclosure teaches combining the functions of the print cylinder with the offset cylinder wherein the rewritable imaging surface is made from material that can be made conformal to the roughness of print media via a high pressure impression cylinder while it maintains good tensile strength necessary for high volume printing. Therefore, we disclose a system and method having the added advantage of reducing the number of high inertia drum components as compared to a typical offset printing system. The disclosed system and method may work with any number of offset ink types but has particular utility with UV lithographic inks.

The invention described herein, when operated according to the method described herein meets the standard of high ink transfer efficiency, for example greater than 95% and in some cases greater than 99% efficiency of transferring ink off of the imaging member and onto the substrate. In addition, the disclosure teaches combining the functions of the print cylinder with the offset cylinder wherein the rewritable imaging surface is made from material that can be made conformal to the roughness of print media via a high pressure impression cylinder while it maintains good tensile strength necessary for high volume printing. Therefore, we disclose a system and method having the added advantage of reducing the number of high inertia drum components as compared to a typical offset printing system. The disclosed system and method may work with any number of offset ink types but has particular utility with UV lithographic inks.

The physics of modern devices and the methods of their production are not absolutes, but rather statistical efforts to produce a desired device and/or result. Even with the utmost of attention being paid to repeatability of processes, the cleanliness of manufacturing facilities, the purity of starting and processing materials, and so forth, variations and imperfections result. Accordingly, no limitation in the description of the present disclosure or its claims can or should be read as absolute. The limitations of the claims are intended to define the boundaries of the present disclosure, up to and including those limitations. To further highlight this, the term "substantially" may occasionally be used herein in association with a claim limitation (although consideration for variations and imperfections is not restricted to only those limitations used with that term). While as difficult to precisely define as the limitations of the present disclosure themselves, we intend that this term be interpreted as "to a large extent", "as nearly as practicable", "within technical limitations", and the like.

Furthermore, while a plurality of preferred exemplary embodiments have been presented in the foregoing detailed description, it should be understood that a vast number of variations exist, and these preferred exemplary embodiments are merely representative examples, and are not intended to limit the scope, applicability or configuration of the disclosure in any way. Various of the above-disclosed and other features and functions, or alternative thereof, may be desirably combined into many other different systems or applications. Various presently unforeseen or unanticipated alternatives, modifications variations, or improvements therein or thereon may be subsequently made by those skilled in the art which are also intended to be encompassed by the claims, below.

Therefore, the foregoing description provides those of ordinary skill in the art with a convenient guide for implementation of the disclosure, and contemplates that various changes in the functions and arrangements of the described embodiments may be made without departing from the spirit and scope of the disclosure defined by the claims thereto.

What is claimed is:

1. A variable data lithography system for applying a multicomponent image to a substrate, comprising:

an imaging member comprising an arbitrarily reimageable surface layer, the arbitrarily reimageable surface layer having:

a surface roughness Ra in a range of 0.1 to 4.0 micrometers (μm); and a lateral spatial scale average distance RSm not exceeding 20 m. RSm being a mean value of a plurality of profile element widths over a determined sample length and representing a peak-to-peak spacing characteristic for a roughened surface of the arbitrarily reimageable surface layer;

a dampening solution subsystem for applying a layer of dampening solution to the arbitrarily reimageable surface layer;

a patterning subsystem for selectively removing portions of the dampening solution layer to expose regions of the arbitrarily reimageable surface layer of the imaging member producing a latent image in the dampening solution;

a marking material subsystem, comprising:

a plurality of marking material assemblies, each of the plurality of marking material assemblies being configured to apply marking material over the arbitrarily reimageable surface layer such that the marking material selectively occupies the exposed regions of the arbitrarily reimageable surface layer where dampening solution is removed by the patterning subsystem to produce an inked latent image with the marking material, each of the plurality of marking material assemblies comprising:

a marking material source; and a marking material transfer subsystem for receiving marking material from the marking material source and applying the marking material to the exposed regions of the arbitrarily reimageable surface of the imaging member via selective contact between a marking material form roller and the arbitrarily reimage of a surface of the imaging member; and a control mechanism configured to engage each of the plurality of marking material assemblies with the arbitrarily reimageable surface of the imaging-member based only on the location of the exposed regions of the arbitrarily reimageable surface and disengage each of the plurality of the marking material assemblies with the arbitrarily reimageable surface of the imaging-member based only on the location of the unexposed regions of the arbitrarily reimageable surface regardless of the rotational orientation of the imaging member, wherein the each marking material form roller is brought into and out of engagement with the arbitrarily reimageable surface layer by the control mechanism while remaining elements of the marking material subsystem remain fixed in position relative to, and disengaged from, the arbitrarily reimageable surface layer of the imaging member; and an image transfer subsystem for transferring the inked latent image to a substrate, the control mechanism controlling the selective engaging and disengaging of each of the plurality of marking material assemblies such that only one of the plurality of marking material assemblies is engaged with the arbitrarily reimageable surface layer at any one time.

2. The variable data lithography system of claim 1, a first of the marking material assemblies applying a first marking material having a first composition and a second of the marking material assemblies applying a second marking material having a second composition, the second composition being different than the first composition.

3. The variable data lithographic system of claim 1, at least one of the plurality of marking material assemblies being an inking assembly for applying ink to the arbitrarily reimageable surface layer of the imaging member.

4. The variable data lithographic system of claim 3, the plurality of the marking material assemblies each being an inking assembly for providing ink to the arbitrarily reimageable surface layer, the each inking assembly providing a different color of ink to the arbitrarily reimageable surface layer.

5. The variable data lithographic system of claim 3, a first inking assembly applying a first ink having a first composition and a second inking assembly applying a second ink having a second composition, the second composition being different from the first composition.

6. The variable data lithographic system of claim 3, at least one of the plurality of marking material assemblies providing a non-visible material to the arbitrarily reimageable surface layer of the imaging member.

7. The variable data lithographic system of claim 1, the control mechanism including an engagement mechanism configured to deflect the imaging member into and out of engagement with each of the plurality of marking material assemblies for the engaging and disengaging of each of the plurality of marking material assemblies.

8. The variable data lithographic system of claim 1, the imaging member includes a printing blanket having the arbitrarily reimageable surface layer.

* * * * *